US008479757B2

(12) United States Patent
Zhou

(10) Patent No.: US 8,479,757 B2
(45) Date of Patent: Jul. 9, 2013

(54) TIE DOWN ANCHOR

(76) Inventor: Wei Zhou, Granger, IN (US)

( * ) Notice: Subject to any disclaimer, the term of this patent is extended or adjusted under 35 U.S.C. 154(b) by 0 days.

(21) Appl. No.: 13/216,540

(22) Filed: Aug. 24, 2011

(65) Prior Publication Data

US 2013/0048043 A1 Feb. 28, 2013

(51) Int. Cl.
*E04H 15/62* (2006.01)

(52) U.S. Cl.
USPC ..... 135/118

(58) Field of Classification Search
USPC ..... 135/118; 52/153–156, 158
See application file for complete search history.

(56) References Cited

U.S. PATENT DOCUMENTS 344,683 A * 6/1886 Sherer ..... 119/786
405,445 A * 6/1889 Thomson ..... 52/158
425,385 A * 4/1890 McKay ..... 119/786
781,221 A * 1/1905 Morris ..... 52/156
1,105,884 A * 8/1914 Crites ..... 52/158
1,317,073 A * 9/1919 Carlson ..... 52/150
3,534,751 A * 10/1970 Peters ..... 135/118
3,903,662 A * 9/1975 Gabliya et al. ..... 52/741.14
4,063,567 A * 12/1977 Martin et al. ..... 135/118
5,243,795 A * 9/1993 Roberts ..... 52/158
5,515,656 A * 5/1996 Mihalich ..... 52/155
5,740,827 A * 4/1998 Swarringim ..... 135/118
2007/0181171 A1 * 8/2007 Roberts ..... 135/118

* cited by examiner

*Primary Examiner* — Noah Chandler Hawk
(74) *Attorney, Agent, or Firm* — Botkin & Hall, LLP

(57) ABSTRACT

A tie down anchor that is particularly useful when tying down objects to the ground and may take the place of ordinary tent stakes due to the tie down anchor's superior holding ability when compared to traditional tent stakes. The tie down anchor has a guide having an angled hole. A main stake extends downwardly from the guide and the main stake includes an aperture. A locking spike is adapted for being received in the angled hole. The aperture in the main stake is positioned to receive the locking stake when the locking stake passes through the angled hole. The stake of this invention is small, light, and of a comparable size to traditional tent stakes.

6 Claims, 9 Drawing Sheets

TIE DOWN ANCHOR

BACKGROUND OF THE INVENTION

Anchoring objects to the ground is important for temporary structures such as tents. Ideally an anchor would require a lot of force to remove from the ground while it is working, yet be easily removed when desired. The anchor should also be small when not in use so it may be easily stored. Present solutions for having a great deal of holding power include auger type earth anchors that are difficult to install, quite large and usually heavy. There is a need for an anchor similar in size to a traditional tent stake, yet provides holding power comparable to an auger type anchor.

SUMMARY OF THE INVENTION

The present invention is a tie down anchor that is particularly useful when tying down objects to the ground and may take the place of ordinary tent stakes due to the tie down anchor's superior holding ability when compared to traditional tent stakes. The tie down anchor has a guide having an angled hole. A main stake extends downwardly from the guide and the main stake includes an aperture. A locking spike is adapted for being received in the angled hole. The aperture in the main stake is positioned to receive the locking stake when the locking stake passes through the angled hole.

The guide may include a stake aperture extending through the guide that is adapted for receiving the main stake. When used with a guide of this type, the main stake has a stop that locates the maximum depth the main stake may extend below the guide. The angled hole is adapted for guiding the locking spike through the aperture in the main stake when the stake extends to its maximum depth below the main stake.

In another aspect of the invention, the main stake may have a guide that is pivotally affixed to the main stake. The guide of this type has an angled hole adapted for receiving the locking stake. The guide is pivotal from a folded position adjacent to the main stake to another position in which the guide is substantially perpendicular to the main stake. A stop is included to limit movement of the guide to be substantially perpendicular to the main stake.

In yet another aspect of the invention, the main stake and guide are integrally joined and the main stake includes an angled hole adapted for guiding the locking spike through an aperture near the lower end of the main stake.

DETAILED DESCRIPTION OF INVENTION

Figure 1:
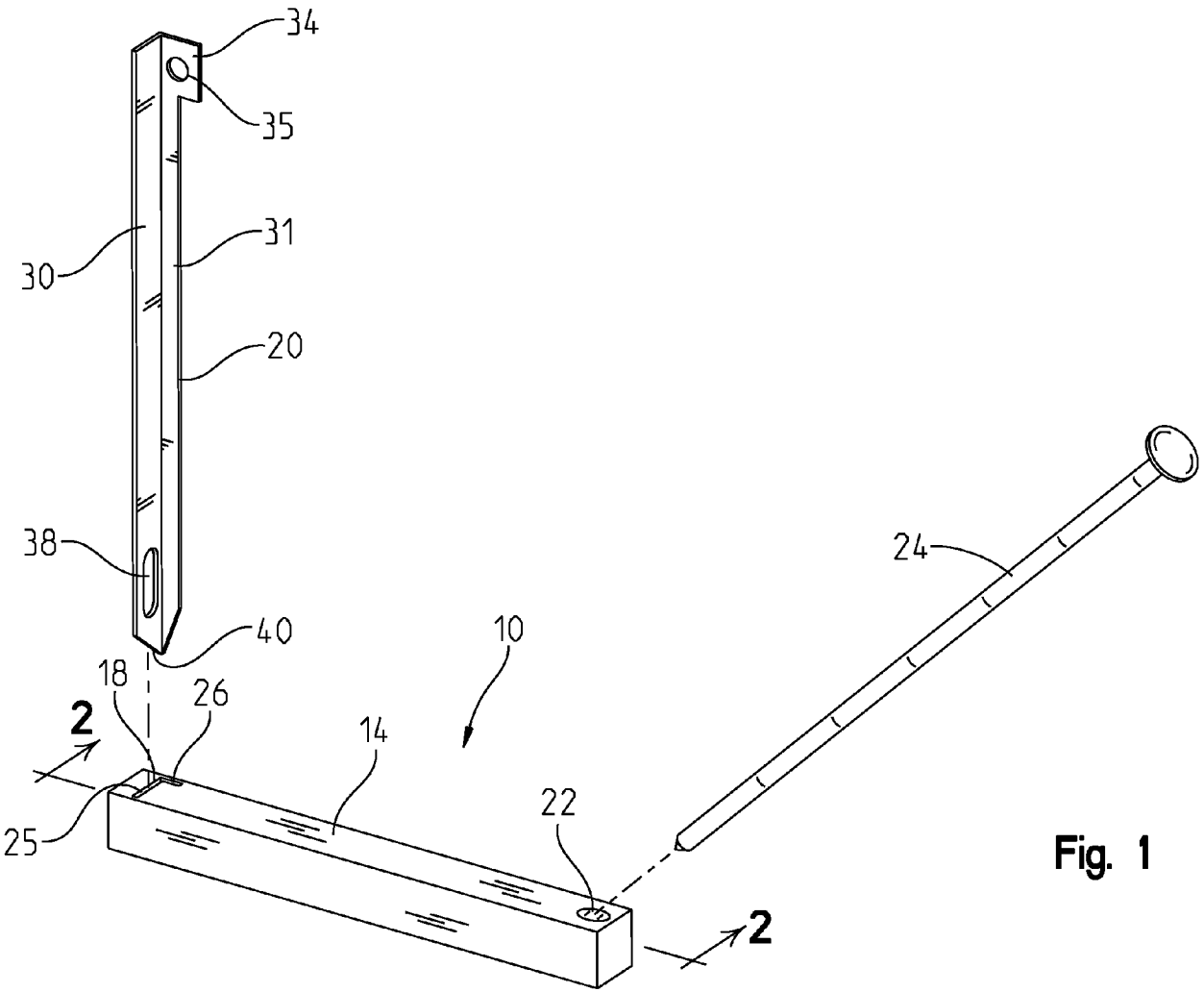
FIG. 1 is an exploded perspective view of a tent stake of this invention.
Figure 2:
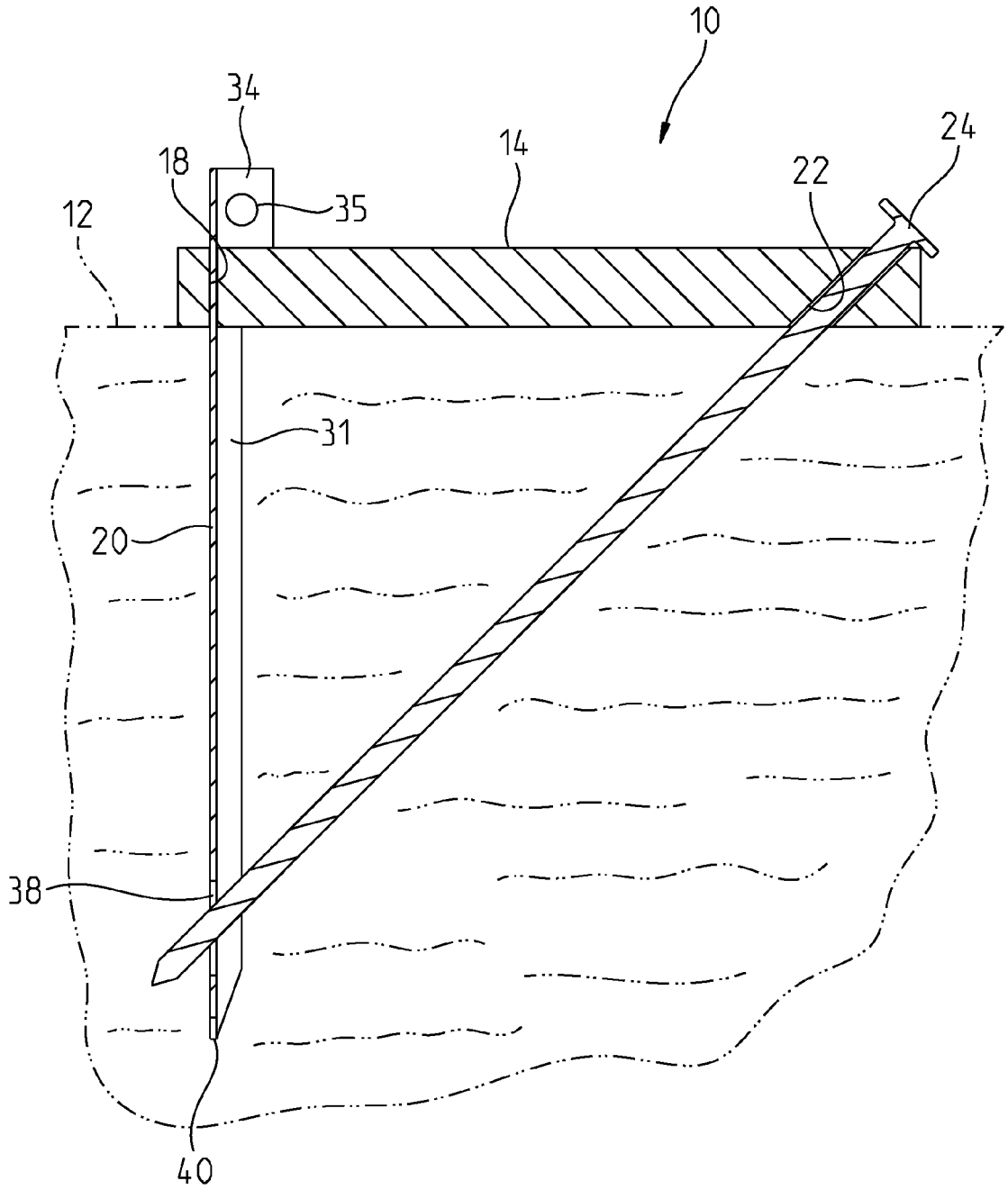
FIG. 2 is a sectional view taken about the line 2-2 in FIG. 1.

FIG. 1 shows the ground anchor 10 of the present invention in an exploded view. The ground anchor 10 is particularly useful for anchoring tents or other objects to the ground 12. FIG. 2 shows a sectional view of the anchor 10 as used in the ground 12. The anchor 10 has a guide 14. The guide 14 has a stake aperture 18 adapted for receiving a main stake 20 and an angled hole 22 adapted for receiving a locking stake 24. The angled hole 22 extends obliquely through the guide 14 and is angled toward the stake aperture 18 when traversing toward the ground 12 through the guide 14. The stake aperture 18 has legs 25 and 26 that are straight slots through the entire thickness of the guide 14. Leg 26 is shorter in length than leg 25. The guide 14 may be made of a solid block of material, as shown in FIGS. 1 and 2, or can be made of tubular stock. When the guide 14 is made of solid stock, as shown in FIGS. 1 and 2, it is easier to insert the locking stake 24 and the main stake 20 into the guide 14 because there will be more bearing surface to guide each of the aforementioned parts through the guide 14. However, in some instances it may be desirable to reduce weight by using a tubular construction as opposed to the solid construction shown in FIGS. 1 and 2. The main stake 20 has flanges 30, 31 that are perpendicular to each other. Standard angle stock may be used to manufacture the main stake 20. One of the flanges 31 is shortened to leave a protrusion 34 near the top of the stake 20. When the main stake 20 is made of standard angle stock having flanges of equal length, the short flange 31 is easily manufactured by removing stock from only one flange of the angle stock. A tie hole 35 is located in the protrusion 34 at the top of flange 31; however, this hole 34 could be located on the other flange 30. The protrusion 34 prevents the main stake 20 from passing through the stake aperture 18. The main stake 20 has a slot 38 near its lower end 40. The lower end 40 is tapered to a point, as shown in FIG. 1, to enhance the main stake's 20 ability to penetrate the ground 12. FIG. 2 shows the ground anchor 10 as it is used in the ground 12. The user of the ground anchor shown in FIG. 2 will first place the guide 14 in a desired location on the ground 12. The main stake 20 will then be inserted into the stake aperture 18. The legs 25 and 26 of the stake aperture 18 will allow for only one possible way to install the stake 20 within the aperture 18. As such, the slot 38 will face the angled hole 22. With the main stake 20 in the stake aperture, the user will then pound the main stake 20 into the ground 12 until it stops due to the protrusion 34 engaging the guide 14, as shown in FIG. 2. When the protrusion 34 engages the guide 14, this will repeatably position the slot 38 in the same location below the guide 14. This corresponds to the fully driven position because the main stake 20 cannot be driven any further. With the main stake 20 securely in the ground in its fully driven position, the locking stake 24 will be placed into the angled hole 22. The angled hole 22 positions the locking stake 24 so it will intersect with the slot 38. The user will then drive the locking stake 24 until it stops against the guide 14. This is the fully driven position of the locking stake 24. The slot 38 has a length chosen to allow for potential variation in the vertical location of the locking stake 24 relative to the guide 14. This variation in vertical height of the locking stake 24, particularly the lower end passing through slot 38, may be the result of clearance in the angled hole 22. This clearance may result from tolerance in the angled hole size 22, variation in the outer diameter of the locking stake 24, clearance between the main stake 20 and stake aperture 18, or potential tolerance in the angularity of the angled hole relative to the guide. The slot 38 size in the main stake 20 is chosen so that, even with the maximum tolerances and necessary clearance between the locking stake 24 and angled hole 22, the angled hole 22 will guide the locking stake 24 to intersect with the slot 38. This intersecting relationship, as shown in FIG. 2, produces a secure anchor to the ground 12. This intersecting relationship may also be had by using the stake aperture 18 in the place of the angled hole 22, so it is the stake aperture 18 that is at an oblique angle relative to the guide 14 and the ground 12, and the locking stake 24 would be perpendicular to the ground 12. The force required to remove the anchor, as shown in FIG. 2, from the ground 12 will necessarily be much larger than that required to remove a single stake. Generally when removing a single piece stake, such as that in the prior art, the easiest way to remove the stake is to pull along the longitudinal axis of the stake. Also, in the case of the present invention, pulling directly upward on the main stake 20 is the easiest way to remove it from the ground. However, the main stake 20 will have the locking stake 24 interlocked within it so a force pulling upward on the main stake 20, along its longitudinal axis, will not easily dislodge it from the ground 12. The user may tie a rope through hole 35. It is also contemplated that a tie hole 35 may be located on the guide 14, itself. Removing the ground anchor 10 from the ground may be accomplished by first pulling the locking stake 24, then the main stake 20.

Figure 3:
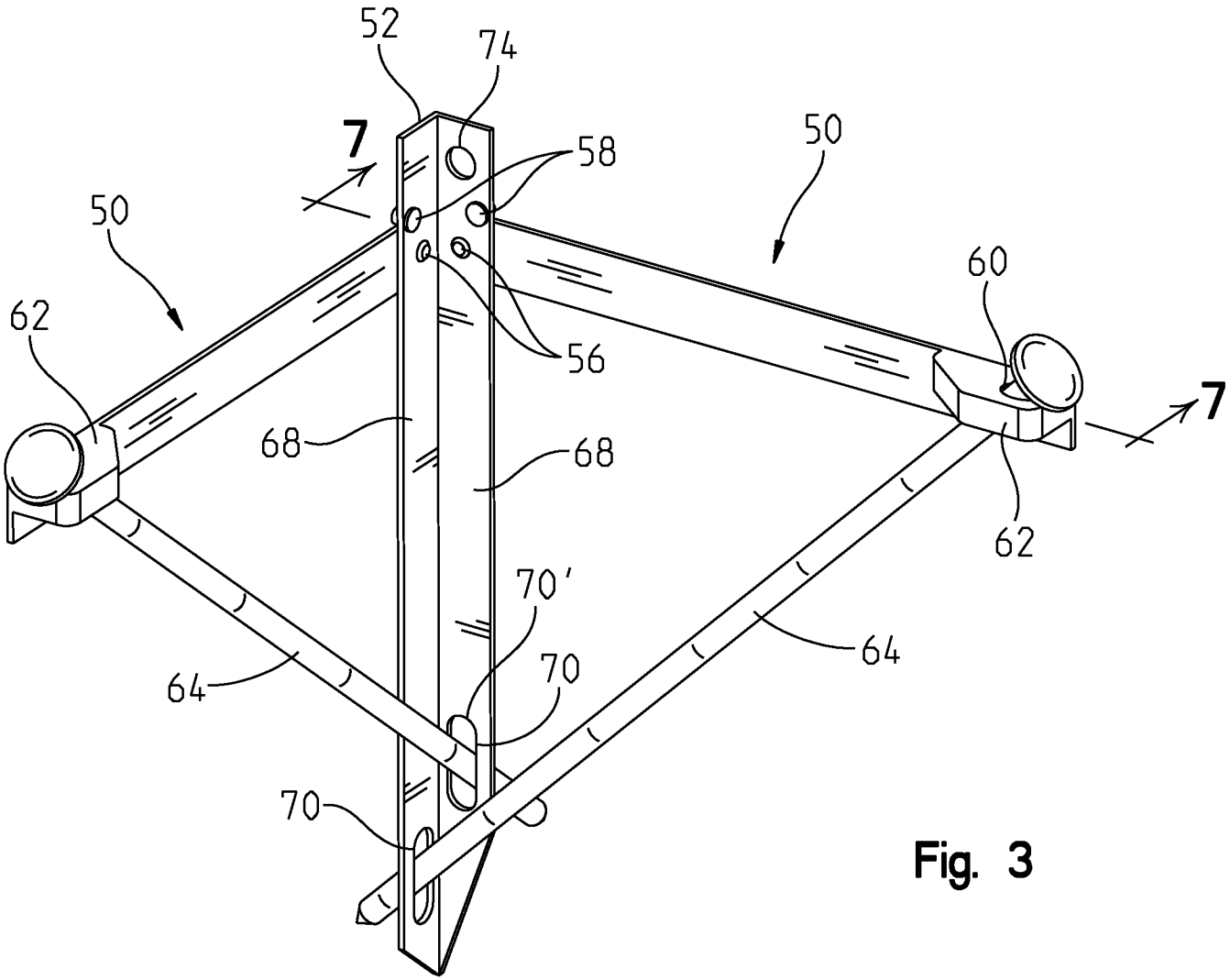
FIG. 3 is a perspective view of another embodiment of the tent stake fully assembled.
Figure 4:
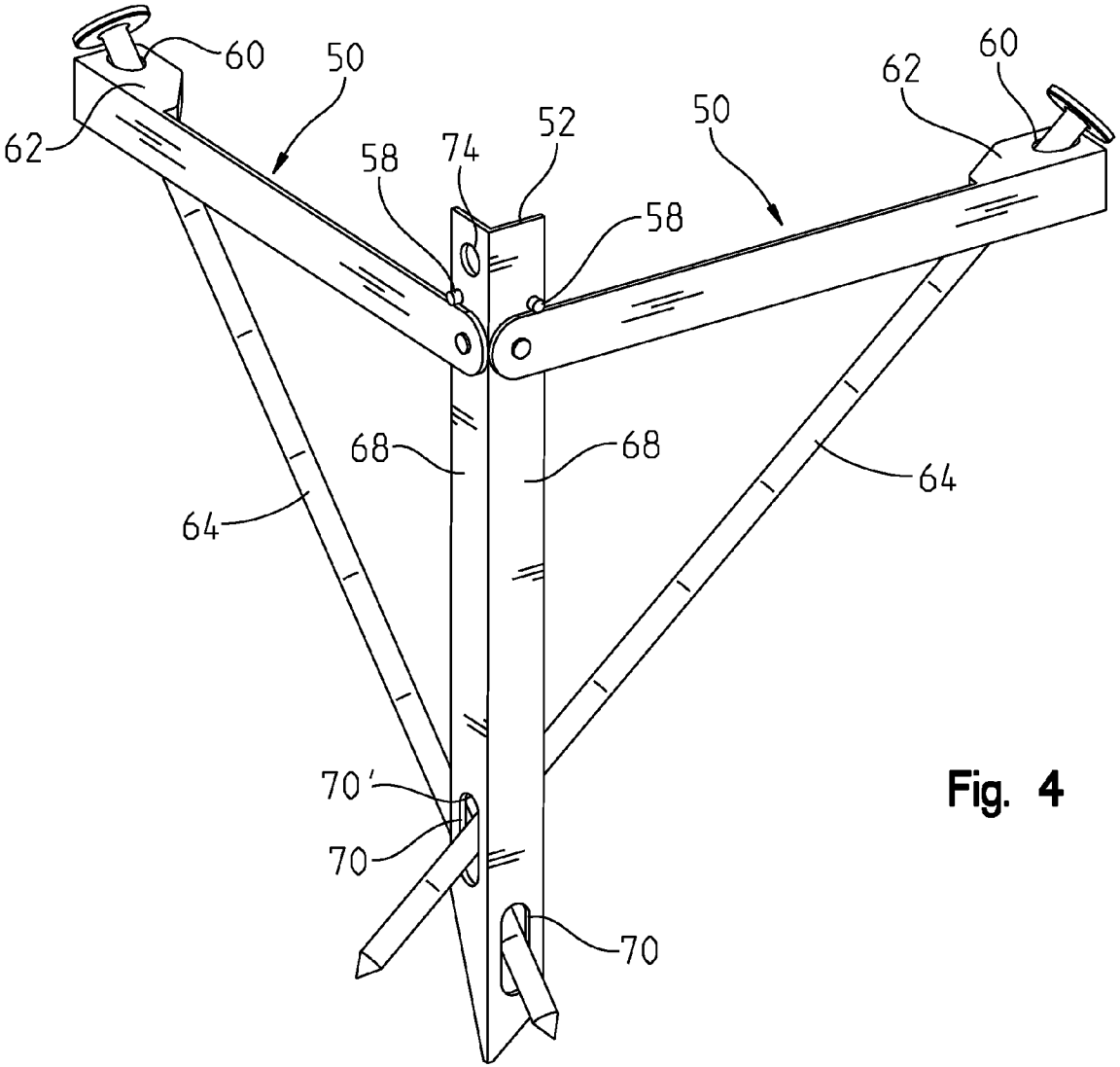
FIG. 4 is a perspective view of the tent stake shown in FIG. 3 viewed from the opposite side as that of FIG. 3.
Figure 5:
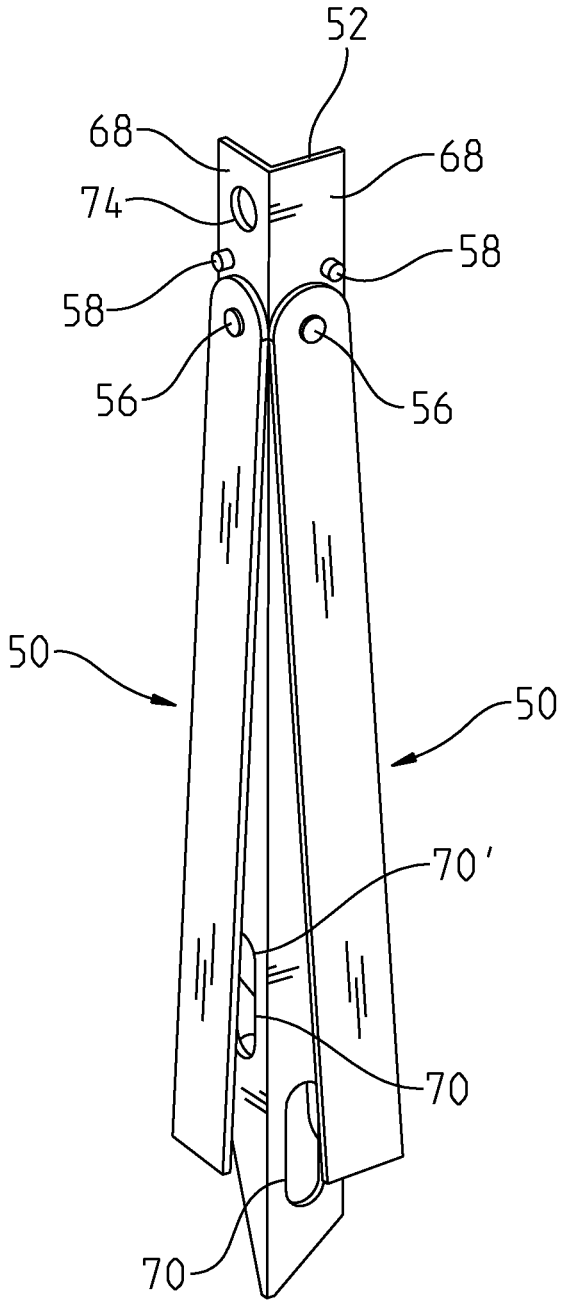
FIG. 5 is a perspective view of the tent stake shown in FIGS. 3-4 with its guides folded down.
Figure 6:
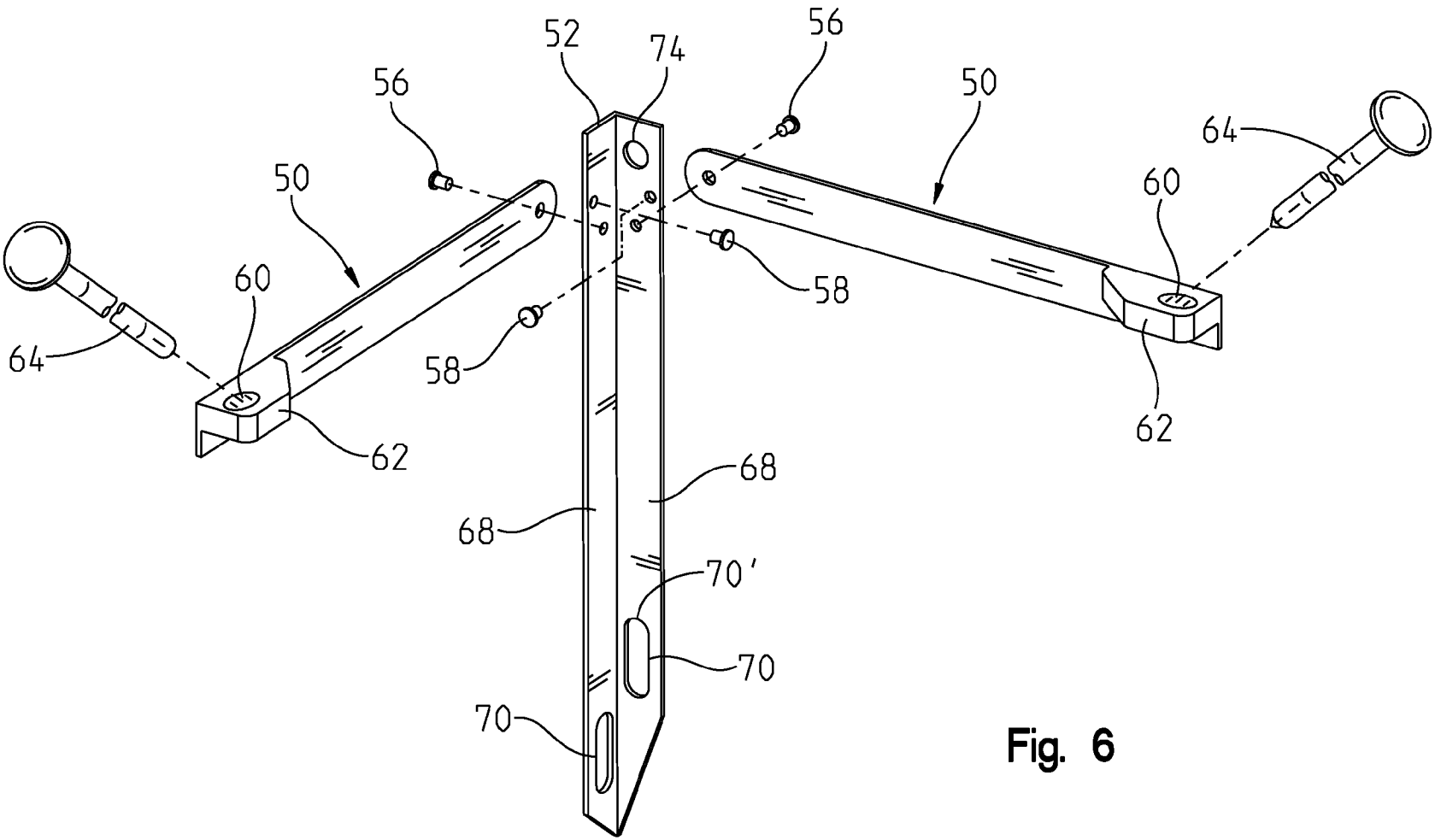
FIG. 6 is an exploded perspective view of the tent stake shown in FIGS. 3-5.
Figure 7:
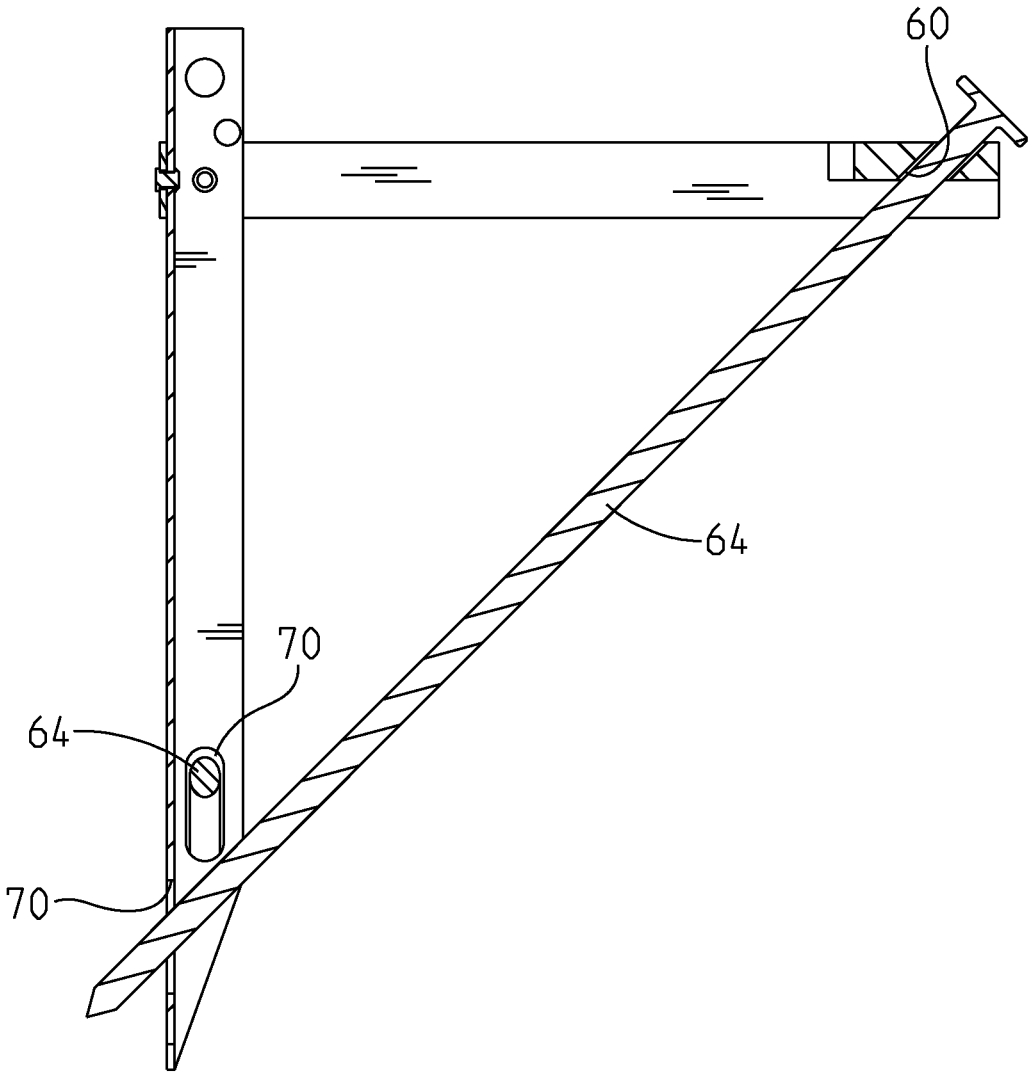
FIG. 7 is a sectional view taken about the line 7-7 in FIG. 3.
Figure 8:
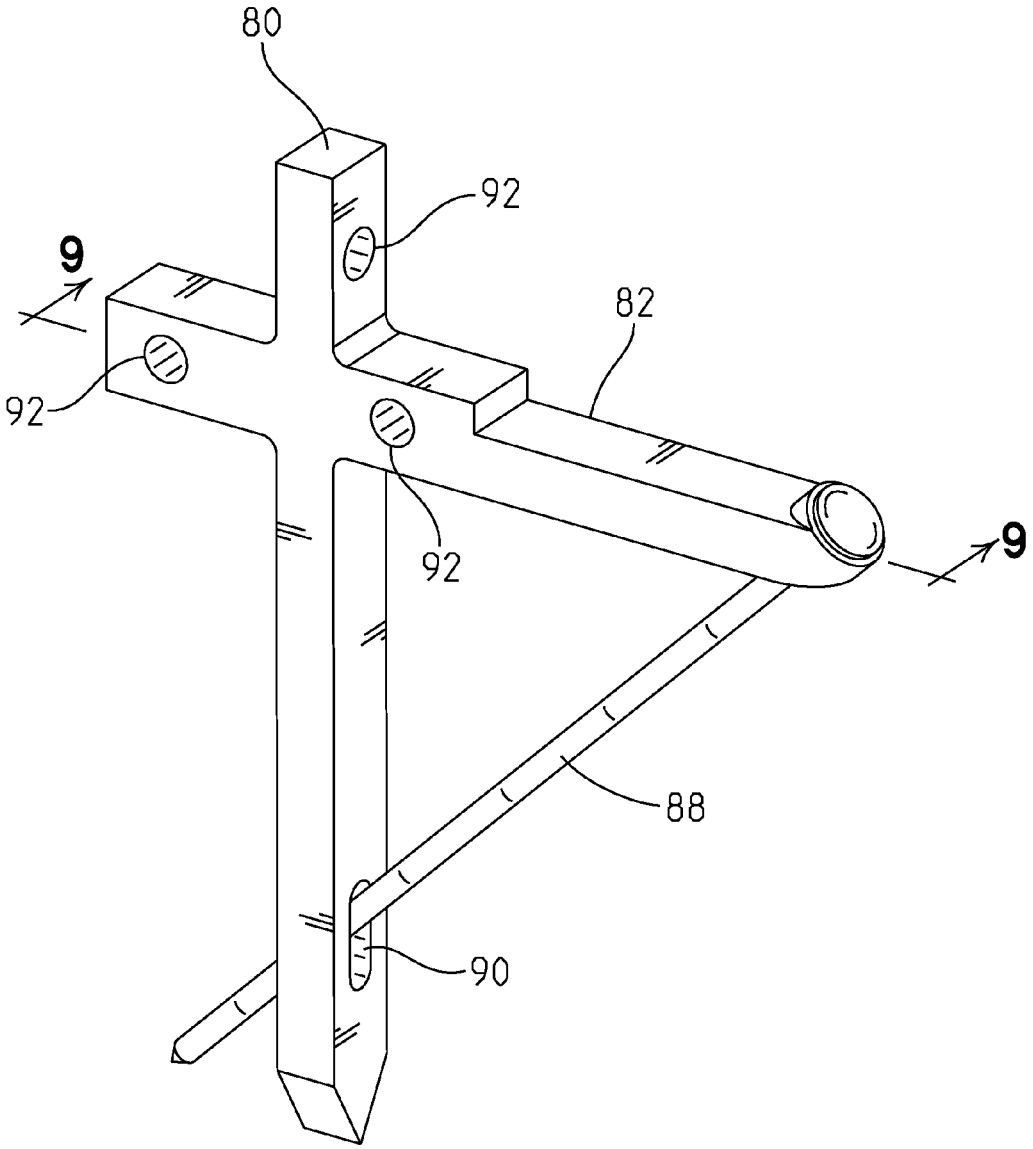
FIG. 8 is a perspective view of another embodiment of the tent stake of the invention.

Guides 50 may also be attached to a main stake 52, as shown in FIG. 3. In this case, each guide 50 is pivotally attached with a rivet 56 to the main stake 52 near its upper end. This pivotal attachment allows the guides 50 to be folded down along the main stake 52, as shown in FIG. 5, and then unfolded, as shown in FIGS. 3 and 4. The limit to which the guides 50 may be folded upward is shown in FIG. 4. The guides 50 are prevented from pivoting upward when they reach the ninety degree position. Each guide 50 has a rivet 58 above it that catches each guide 50, as shown in FIG. 4. Each guide 50 has an angled hole 60 extending through a flange 62. The angled holes 60 are adapted for receiving a locking stake 64. The angled holes 60 are set at slightly different angles with respect to their corresponding guides 50. This is necessary because flanges 68 on the main stake have slots 70 staggered in their vertical position, as shown in FIG. 3. The upper slot 70' has its lowermost portion above the uppermost portion of the lower slot. The different vertical heights of the slots 70, on their respective flanges 68, are necessary to prevent locking stakes 64 from hitting each other when driven through their corresponding angled holes 60. FIG. 3 shows how the locking stakes 64 pass near each other, but do not touch. The main stake 52 includes a tie hole 74 for receiving a rope.

Figure 9:
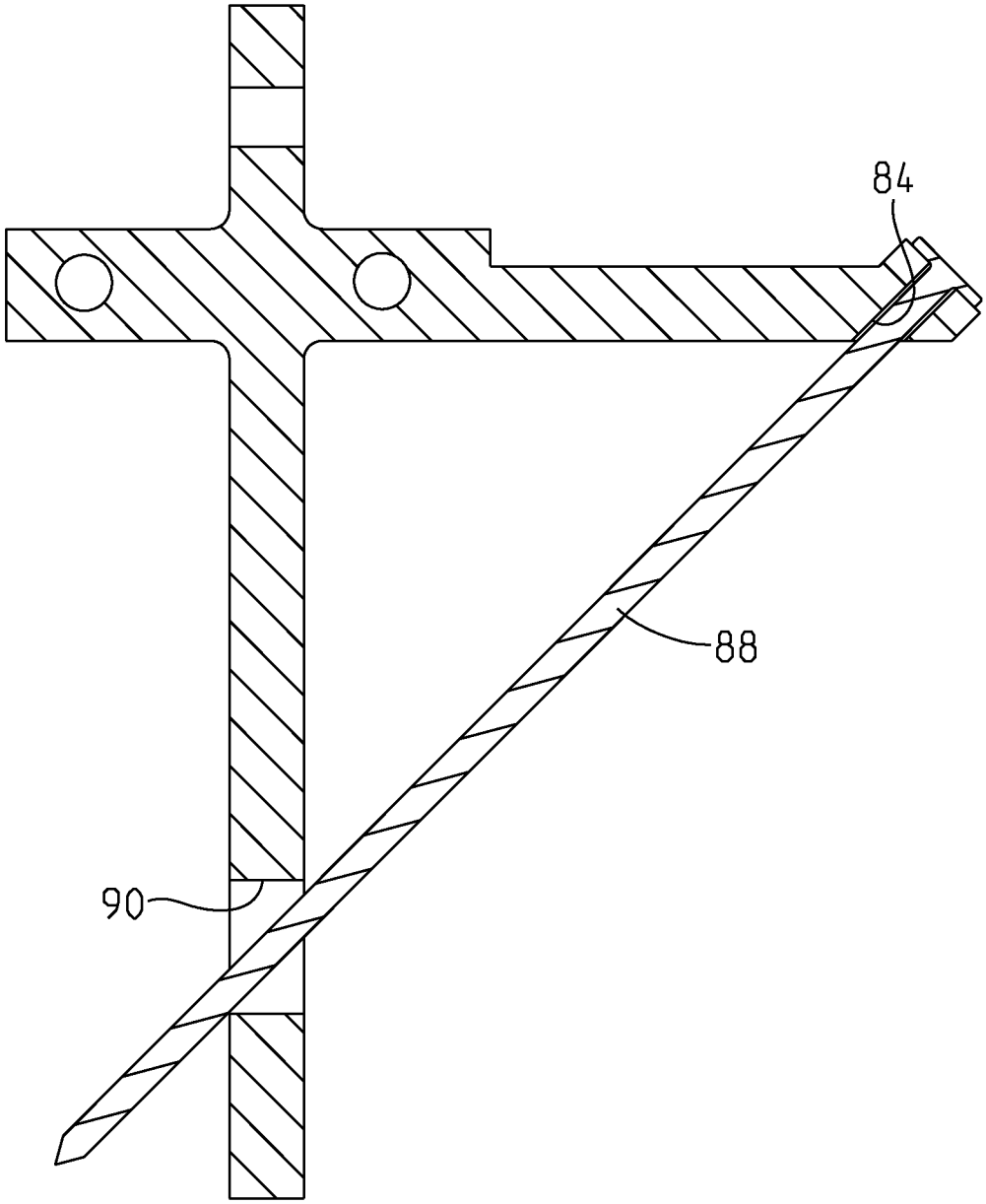
FIG. 9 is sectional view taken about the line 9-9 in FIG. 8.

A main stake 80 may also have an integral guide 82 extending from the main stake 80. In this case, the guide 82 has an angled hole 84 to guide a locking stake 88 through a slot 90 near the lower end of the main stake 80. Due to the fact that the main stake 80 and the guide 82 are integral, there is less overall variation in the final position of the locking stake 88 when it is fully driven into the angled hole 84, as shown in FIG. 9. Thus, the slot 90 does not need to be as long as would otherwise be necessary if there were more tolerance between separate parts that would increase the variation in the final position of the locking stake 88. Tie holes 92 are located in the top of the main stake 80 and on opposite sides of the main stake 80 in the guide 82.

This invention is not limited to the details above, but may be modified within the scope of the following claims.

What is claimed is:

1. An anchor comprising:

a guide, said guide having an angled hole and a stake aperture spaced from said angled hole and separately located therefrom extending therethrough;

a main stake adapted for being received in said stake aperture and extending downwardly through said guide, said main stake including a pair of flanges being substantially perpendicular to each other and extending longitudinally along the entire length of said stake, said main stake having an aperture and a stop that is a protrusion extending outwardly of one of said flanges to prevent said main stake from moving through said stake aperture and for locating a maximum depth said main stake may extend below said guide; and a locking stake being adapted for being received in said angled hole, said aperture of said main stake being positioned to receive said locking stake to provide an intersecting relationship of said locking stake extending through said main stake at a location spaced from said guide, said angled hole adapted for guiding said locking stake through said aperture in said main stake when said main stake extends to its maximum depth below said guide.

2. An anchor as claimed in claim 1, wherein said flanges of said main stake are joined substantially perpendicular to each other.

3. An anchor as claimed in claim 1 , wherein one of said flanges is shorter than said other flange.

4. An anchor as claimed in claim 3, wherein said other flange includes said aperture.

5. An anchor as claimed in claim 4, wherein said one flange includes said stop.

6. An anchor as claimed in claim 5, wherein said one flange includes a second hole above said stop.

* * * * *